US005119604A

United States Patent [19]

Peterson et al.

[11] Patent Number: 5,119,604

[45] Date of Patent: Jun. 9, 1992

[54] RIDGE CAP ASSEMBLY FOR TILE ROOFS

[75] Inventors: Lonnie R. Peterson; David D. Pruitte, both of Snohomish, Wash.

[73] Assignee: American Building & Roofing, Inc., Everett, Wash.

[21] Appl. No.: 696,001

[22] Filed: May 6, 1991

[51] Int. Cl.[5] ..... E04D 3/38

[52] U.S. Cl. ..... 52/57; 52/58; 52/276; 52/530

[58] Field of Search ..... 52/57, 58, 276, 530

[56] References Cited

U.S. PATENT DOCUMENTS 3,905,165 9/1975 Kneisel ..... 52/58

4,185,141 1/1980 Krejci et al. ..... 52/517

4,189,889 2/1980 Yanoh ..... 52/530

4,936,898 6/1990 Nielsen ..... 71/32

*Primary Examiner*—David A. Scherbel

*Assistant Examiner*—Wynn Wood

*Attorney, Agent, or Firm*—Harry M. Cross, Jr.

[57] ABSTRACT

A method of installing a composite zinc/pressure-sensitive adhesive strip between the top course of a tile roof and the tile ridge cap. The tile roof cap assembly attained by the method is also described whereby a portion of the zinc is exposed to weather so that the zinc may erode and wash down the roof surface below the ridge cap to prevent fungus and moss growth.

4 Claims, 1 Drawing Sheet

RIDGE CAP ASSEMBLY FOR TILE ROOFS

FIELD OF THE INVENTION

This invention relates to tile roof construction and particularly to preventing fungus and moss growth on tile roofs.

BACKGROUND OF THE INVENTION

It is a common building technique in the construction of wood and composition roofs to provide a zinc-containing metal strip along the side of a roof ridge to prevent fungus and moss growth on the roof surface below the strip. The zinc-containing metal strip is nailed to the upper course of roofing and then the ridge cap is applied over upper course such that it overlays the upper edge of the metal strip. The major portion of the metal strip extends down beyond the edge of the cap and is exposed to the atmosphere. The zinc-containing metal strip is susceptible to spontaneous erosion by rainwater; the rainwater, serving as an electrolyte, dissolves the zinc. The zinc is converted into an oxide that is washed down to bathe the roof surface below the metal strip.

Until the present invention, there has been no comparable system available for tile roofs. Such roofs are made of interlocked or overlapped tile members. These members, whether made of clay or concrete or plastic, are monolithic. Fasteners such as nails cannot be driven into these members. Such members are either too hard or too fragile to be nailed into. Therefore, the use of a zinc-containing metal strip, which heretofore was nailed into the upper course of the roofing. could not be successfully fastened to the upper tile course.

SUMMARY OF THE INVENTION

The present invention provides a system and method for a tile roof cap assembly that successfully incorporates a zinc-containing metal strip into the structure. The present invention provides a secure installation of the zinc-containing metal strip with the upper edge of the metal strip overlaid by the tile cap. In the context of this invention, the cap assembly is most usually a ridge cap assembly; however it is also suitable for application to a hip cap assembly. It will herein be described in its application to a ridge cap, but it is to be understood that the teachings herein are applicable to hip caps.

In a roof constructed according to this invention, the normal tile members, of whatever design or configuration, are laid up and fastened to the roof understructure (framing) in the usual manner. As is the usual case, when the upper course on both sides of the roof are laid up, a gap exists between the longitudinal edges of the adjacent upper courses. This gap is overlaid by ridge cap members. These ridge cap members may be secured in place by fasteners or may simply rest in place. The ridge cap members may be interlocked or overlapped, depending on the design and structure of the ridge cap members. In any event, the longitudinal edges of the ridge cap members overlay the upper tile courses so that the tile course upper longitudinal edges are shielded from the atmosphere by the overlaying ridge cap members.

In the present invention, a zinc-containing metal strip is provided with a band of self-adhesive (i.e. pressure sensitive adhesive) on its underside. The metal strip, thus banded, is applied to an upper tile course, just below the upper longitudinal edge of that tile course. The metal strip is conformed to the contour of that upper tile course during application so that the band of self-adhesive is substantially adhered to the upper tile course substantially all along its length. The metal strip is sufficiently thin that it will be easily conformed to the tile roof contour by hand pressure as the strip is applied. After application of the metal strip, the ridge cap members are installed to overlay the upper longitudinal edge of the metal strip, as well as the upper longitudinal edge of the tile roof upper course. In one form of the invention, the adhesive band may be as wide as the metal strip.

In the form of the invention shown in the drawings, the adhesive band has a width that is less than the width of the metal strip and is generally centered along the metal strip. Therefore, the metal strip may be installed along the upper tile course with the upper longitudinal edge of the metal strip generally even with the upper longitudinal edge of the upper tile course, with the adhesive set back from the upper longitudinal edge of the upper tile course. This feature will enable the ridge cap members to seat against the now-metal-strip-overlaid upper tile course in very much the same manner as if the metal strip were not present. This is so because the metal strip, by itself, is very thin relatively-speaking and essentially not apparent to the alignment and relationship of the ridge cap members to the upper tile course. The composite of the metal strip and underlying adhesive band is thicker and therefore more apparent. By setting the upper edge of the adhesive band back from the upper edge of the metal strip, this advantageous result is obtained. In order to simplify application, both longitudinal edges of the adhesive band are set back from the adjacent longitudinal edges of the metal strip; thus not requiring the installer to determine which edge of the metal strip is to be oriented toward the ridge.

With the adhesive band set back, as described above, the portion of the metal strip between the upper edge of the adhesive band and the upper longitudinal edge of the metal strip will tend to become angled in toward the upper tile course, making a smooth transition from the metal strip to the contacting edge of the ridge cap members.

DETAILED DESCRIPTION OF THE INVENTION

Figure 1:
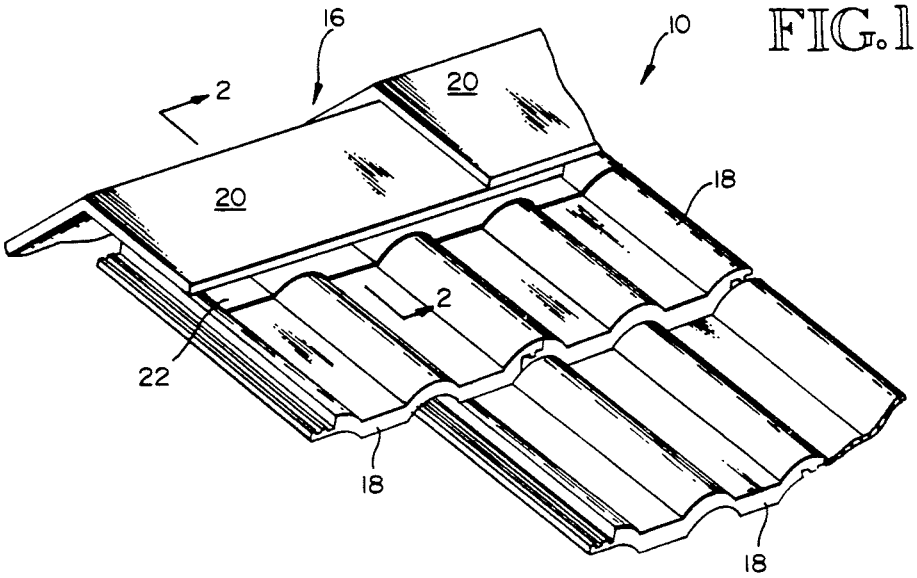
FIG. 1 is a perspective view of the portion of a tiled roof showing application of the metal strip according to the invention.
Figure 2:
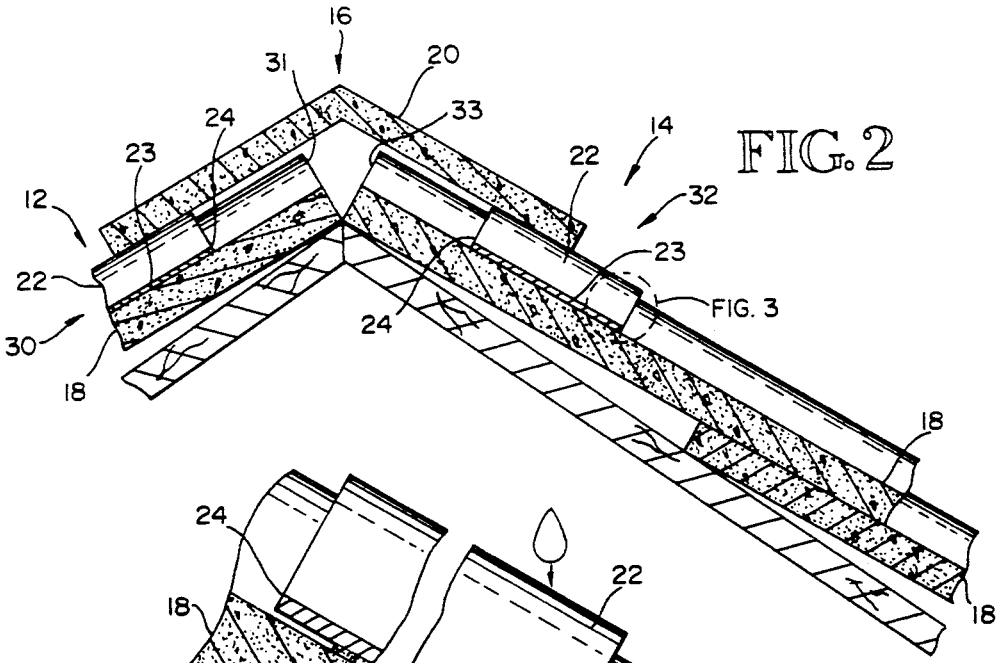
FIG. 2 is a cross-section taken along the lines 2—2 of FIG. 1 illustrating one embodiment of the metal strip.

As shown in the drawings, a roof 10, having inclined surfaces 12 and 14 and a roof ridge 16, is surfaced with tile roofing members. These tile roofing members consist of a plurality of overlapping or interlocked tile members 18 and a plurality of overlapping or interlocked ridge tile members 20. If the roof design had hips and valleys, suitable tile members would be provided therefor also. In the present invention, the tile members may be of any style or composition typically available today. These may be composed of clay, concrete or plastic. They are characterized in general as being monolithic, and are not susceptible to having objects readily fastened to them by nailing or screwing. Clay tile, for example, are too fragile to enable nails to be driven into them.

At the roof ridge, the tile applied to the inclined surfaces terminate in upper courses 30–32, each having an upper longitudinal edge 31, 33, with a gap 34 between the adjacent longitudinal edges. It is this gap in the roofing that is covered by the ridge tile members. In the present invention, along each upper tile course, a metal strip 22 is applied to the tiles making up the upper course. This metal strip has a high zinc content, for example on the order of 99% zinc. The metal strip is applied to each upper tile course so that the upper edge 24 of the metal strip is generally aligned parallel with the upper longitudinal edge 31 or 33 of the tile upper course. The ridge tile members, then, contact the outer surface of the metal strip and bear against it as shown.

Figure 3:
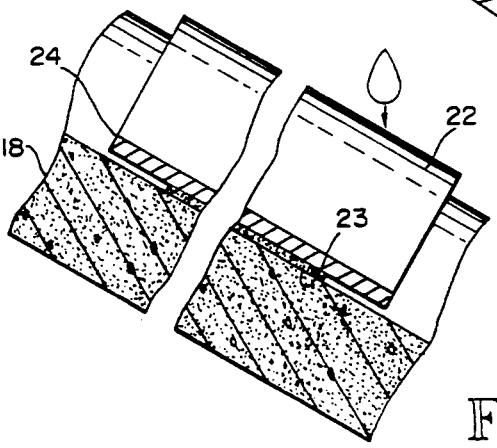
FIG. 3 is a partial cross-section of the metal strip applied to the an underlying tile, illustrating another embodiment of the metal strip.

The metal strip 22 is adhered to the tile upper course by means of an adhesive band 23. The composite strip would have a high zinc content, for example on the order of 68%. This adhesive band 23, as shonw in FIG. 3, may have a width less than the width of strip 22 and be positioned equidistant between the side edges (the longitudinal edges) of the strip as shown. The adhesive band is composed of a self-adhesive material, preferably from the family of butyl rubber copolymers that are tacky and deformable and have a formulation suitable for use as pressure-sensitive, self-adhesive tapes. Such butyl rubber compositions are described, for example, in the *Handbook of Adhesive*, Second Edition, 1977, Van Nostrand Reinhold Company, New York, pages 259–260, 267 and 268. These butyl rubber compositions are only partially cross-linked, have a high proportion of tackifiers, and are quite elastic and deformable. The adhesive must be quite elastic and deformable so as to be adherable to whatever complex surface configuration is provided by the interlocked or overlapped tile members. Prior to application to the tile roof, the metal strip adhesive band is covered by a release paper to protect what would be an otherwise-exposed tacky surface. A suitable release paper would be a silicone-treated or otherwise treated to have low adhesiveness. This release paper is pealed off to expose the pressure-sensitive adhesive as the metal strip is applied to the tile upper course.

The zinc-containing metal strip 22 is thin, on the order of 0.010 inches thick, and narrow, on the order of about 3 inches wide. The adhesive band 23 is narrower so as to provide a set back of about 0.050 inches along each edge. The adhesive band is about 33 mils thick. In a preferred configuration, the composite metal/adhesive strip may be provided in a roll on the order of 50 ft. long.

The composite strip may be applied from the roll by unwinding a portion, peeling the release paper from the portion to expose the adhesive, and then secure the portion to the roof surface. Then, the strip may be unrolled, and the release paper peeled from the roll as the strip is unwound, and the exposed strip progressively applied to the roof surface. Thus, the release paper is peeled off as the composite strip is unrolled and adhered to the tile roof surface. The composite strip would be severed from the supply roll when no more stripping is required.

Alternately, the composite strip would be unrolled and cut to length, then the release paper would be pealed off as the strip is laid against the tile upper course and manually pressed into place, manually conforming the composite strip to the contour of the upper tile course.

While the preferred embodiment of the invention has been described herein, variations in the design may be made. The scope of the invention, therefore, is only to be limited by the claims appended hereto.

The embodiments of the invention in which an exclusive property is claimed are defined as follows:

We claim:

1. A method of installing a tile roof cap assembly on a roof having a plurality of tile members laid up to an upper tile course comprising the steps of providing an elongated zinc-containing metal strip to which a band of self-adhesive composition has been applied to provide a composite metal adhesive strip; applying the composite metal/adhesive strip solely to said upper tile course and conforming the composite strip to the contour of the tile members whereby said composite metal strip is adhered to said upper tile course by means of said adhesive band; and installing a plurality of tile cap members to overlay said upper tile course with said composite strip being exposed to the atmosphere whereby rainwater may contact the exposed composite strip to erode zinc therefrom to produce a zinc-containing solution to bath the roof therewith.

2. The method of claim 1 wherein said composite metal/adhesive strip is provided with an adhesive band of narrower width than said metal strip; and applying said composite strip to said upper tile course with the upper longitudinal edge of said metal strip being generally aligned with the longitudinal upper edge of said upper tile course, whereby said adhesive band is set back from said upper longitudinal edge of said upper tile course.

3. A tile roof cap assembly for a tile roof having a plurality of tile members laid up to an upper tile course comprising an elongated zinc-containing metal strip having an elongated self-adhesive band applied to the underside of said metal strip, the composite strip of metal and adhesive being applied and conformed to the surface of said upper tile course; a plurality of tile cap members positioned to overlay said upper tile course with a portion of said composite strip being exposed to the atmosphere.

4. The assembly of claim 3 wherein said composite metal/adhesive strip is provided with an adhesive band of narrower width than said metal strip; and said composite strip is positioned on said upper tile course with the upper longitudinal edge of said metal strip being generally aligned with the longitudinal upper edge of said upper tile course, whereby said adhesive band is set back from said upper longitudinal edge of said upper tile course.

* * * * *